United States Patent [19]

Ise et al.

[11] Patent Number: 4,600,363

[45] Date of Patent: Jul. 15, 1986

[54] EJECTOR PUMP HAVING AN ELECTROMAGNETIC MOTIVE FLUID VALVE

[75] Inventors: Yoji Ise; Masakichi Kawada, both of Tokyo, Japan

[73] Assignee: Myotoku, Ltd., Tokyo, Japan

[21] Appl. No.: 700,560

[22] Filed: Feb. 11, 1985

[30] Foreign Application Priority Data

Feb. 21, 1984 [JP] Japan ..... 59-31085

[51] Int. Cl.[4] ..... F04F 5/48

[52] U.S. Cl. ..... 417/187; 294/64.2; 137/630.14

[58] Field of Search ..... 417/182, 184, 187–189; 294/64.2; 137/630.14

[56] References Cited

U.S. PATENT DOCUMENTS

| | | | |
|---|---|---|---|
| 1,080,420 | 12/1913 | Clifton | 417/187 |
| 1,430,263 | 9/1922 | Sage | 417/187 X |
| 2,874,989 | 2/1959 | Reynolds | 417/187 X |
| 3,011,751 | 12/1961 | Delany et al. | 137/630.14 X |
| 3,967,849 | 7/1976 | Cagle | 417/184 X |
| 4,269,227 | 5/1981 | Araki et al. | 137/630.14 |
| 4,274,444 | 6/1981 | Ruyak | 137/630.14 |
| 4,402,651 | 9/1983 | Ise | 417/182 |
| 4,432,701 | 2/1984 | Ise | 417/187 |

FOREIGN PATENT DOCUMENTS

| | | | |
|---|---|---|---|
| 2655308 | 6/1978 | Fed. Rep. of Germany | 417/182 |
| 1506492 | 6/1981 | Fed. Rep. of Germany | 294/64.2 |
| 25905 | 3/1978 | Japan | 417/182 |
| 51998 | 4/1980 | Japan | 417/187 |
| 2033964 | 5/1980 | United Kingdom | 417/182 |

*Primary Examiner*—William L. Freeh
*Assistant Examiner*—Paul F. Neils
*Attorney, Agent, or Firm*—Robert E. Burns; Emmanuel J. Lobato; Bruce L. Adams

[57] ABSTRACT

An ejector pump which is used with a suction disk for carrying an article. In the bore of a pump body, there are fitted a nozzle block having a nozzle opening and an ejector block which has an ejector opening aligned with the nozzle opening of the nozzle block, so that suction chamber formed between the nozzle opening and the ejector opening may communicate with a suction port which is formed in one side of the pump body. In the bore of the pump body, too, is disposed an electromagnetic valve which has a moving member for opening and closing the entrance of the nozzle opening with its leading end position.

3 Claims, 5 Drawing Figures

EJECTOR PUMP HAVING AN ELECTROMAGNETIC MOTIVE FLUID VALVE

BACKGROUND OF THE INVENTION

The present invention relates to an ejector pump for establishing a vacuum and, more particularly, to an ejector pump in which compressed air is injected from a nozzle opening into an ejector opening so that air occupying a suction chamber formed between the nozzle opening and the ejector opening may be evacuated to establish a vacuum in the suction chamber and in a system connected to the former.

An ejector pump of the above-specified type according to the prior art is equipped with an electromagnetic valve around its body so that a pilot valve for opening and closing a nozzle opening may be actuated by the electromagnetic valve. As a result, the ejector pump of the prior art has a complicated structure and a large overall size.

SUMMARY OF THE INVENTION

It is, therefore, an object of the present invention to provide an ejector pump having a body, in which an electromagnetic valve is mounted so that a nozzle opening may be opened and closed directly by means of a moving member of the valve, whereby the pump can have its structure made compact and small-sized.

A major feature of the present invention, is provision of an ejector pump comprising: a pump body having a bore formed longitudinally thereof and a suction port formed on one side thereof. A nozzle block is fitted in the bore of the pump body and has a nozzle opening. An ejector block is fitted in the bore of the pump body and has an ejector opening aligned with the nozzle opening of said nozzle block to define a suction chamber together with the nozzle opening and to provide communication of the suction chamber therethrough with the suction port. An electromagnetic valve is fitted in the bore of the pump body and has a moving member for opening and closing the entrance of the nozzle opening of the nozzle block at the leading end portion thereof.

BRIEF DESCRIPTION OF THE DRAWING

Other objects, features and advantages of the present invention will become apparent from the following description taken in connection with the embodiments thereof with reference to the accompanying drawings, in which.

DESCRIPTION OF THE PREFERRED EMBODIMENT

Figure 1:
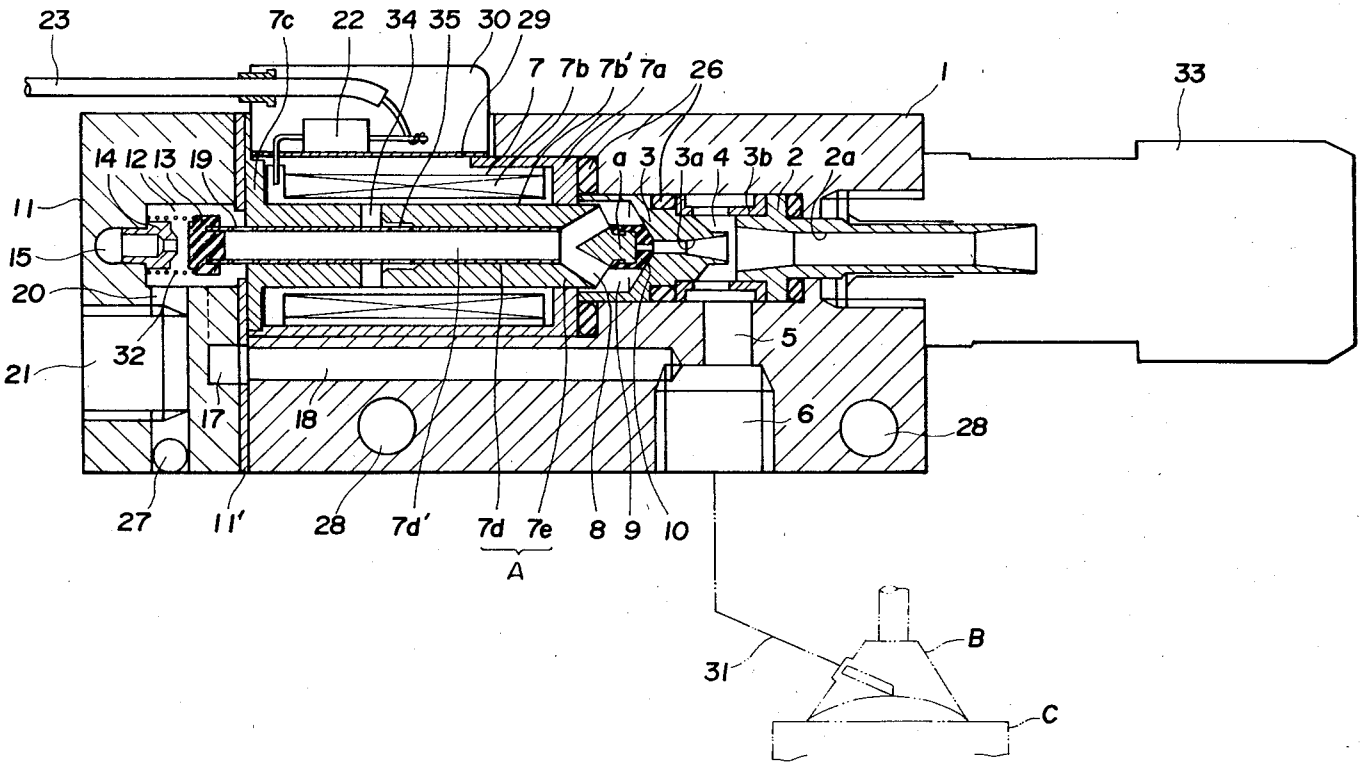
FIG. 1 is a longitudinally sectional front elevation view of one embodiment of the ejector pump according to the present invention.
Figure 2:
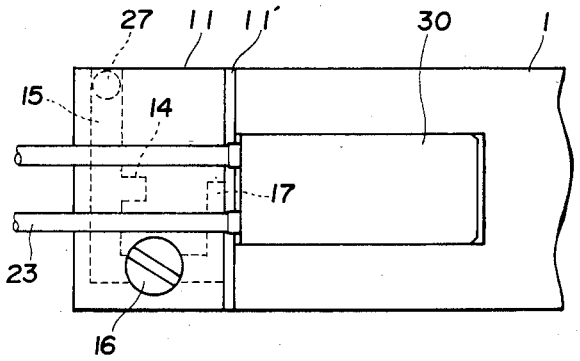
FIG. 2 is a fragmentary top plan view of a portion of the same.
Figure 3:
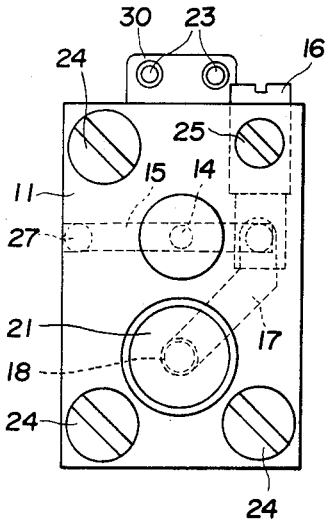
FIG. 3 is an end view of an end block of the same.
Figure 4:
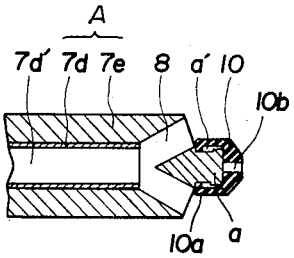
FIG. 4 is an enlarged sectional view showing a downstream end portion of a moving member of the same.

The present invention will be described in detail in the following in connection with the embodiments thereof with reference to the accompanying drawings. Indicated at reference numeral 1 in FIGS. 1 to 4 is a generally rectangular pump body which is formed therein with a bore extending longitudinally therethrough. In this bore, there are fitted through a spacer 3*b* in a recited order from the righthand or downstream end an ejector block 2, which has an ejector passage 2*a*, and a nozzle block 3 which has a nozzle passage 3*a* aligned with the ejector passage 2*a*. A suction chamber 4 communicates through a communication opening 5 with a suction port 6 which is formed in one or lower side of the pump body 1.

At the lefthand or upstream of the nozzle block 3, there is fitted in the body bore an electromagnetic valve 7. This electromagnetic valve 7 is constructed, as shown in FIG. 1, to have a housing 7*a* in which a solenoid 7*b* is mounted. To one end (i.e., lefthand or upstream end) portion of the bobbin 7*b*' of the solenoid 7*b*, there is fixed a center post 7*c* having a bore, in which a communication pipe 7*d* is slidably fitted. In the righthand or downstream portion of the communication pipe 7*d*, there is press-fitted a plunger 7*e* which is slidably supported on the bobbin 7*b*' of the solenoid 7*b* thereby to construct together an elongate moving member A. The communication pipe 7*d* has its communication passage 7*d*' communicating through a communication opening 8, which is formed in the leading or downstream end of the plunger 7*e*, with a gap or space 9 which is formed at the entrance of the nozzle passage 3*a*. On the leading end portion of the plunger 7*e*, moreover, there is mounted a valve member 10 which is made of an elastic material such as rubber or a synthetic resin. The valve member 10 is loosely fitted on the leading end portion a of the plunger 7*e*, as better seen in FIG. 4, such that its inward flange 10*a* engages with a groove a' formed in that leading end portion a. Moreover, the valve member 10 is formed at the center portion of its leading end with a communication opening 10*b* having a small diameter.

At end block 11 is fixed to the left end portion of the pump body 1 through a gasket 11'. The aforementioned communication pipe 7*d* has its lefthand or upstream end protruding from the center post 7*c* into an air chamber 12 which is formed in the end block 11. On the protruding end of the communication pipe 7*d*, there is mounted a valve member 13 which is also made of an elastic material such as rubber or a synthetic resin. The air chamber 12 is provided with a valve seat 14 for the valve member 13. The air chamber has communication with the suction port 6 by way of a transverse communication opening 15, a control valve 16, a groove 17 (as better seen in FIGS. 2 and 3), which is formed in the end face contacting with the gasket 11', and a communication passage 18 which is formed in the pump body 1. On the other hand, the communication pipe 7*d* has its communication passage 7*d*' communicating through openings 19, which are formed in the base or most upstream portion of the communication pipe 7*d*, with the air chamber 12, which in turn has communication with a compressed air inlet port 21 via a communication passage 20 formed in the end block 11.

The aforementioned solenoid 7*b* is connected with a power supply through a rectifier 22, electrical lead 23, a switch and so on. The communication pipe 7*d* forming a part of the aforementioned moving member A is made of a non-magnetic material (e.g., austenitic stainless steel). On the contrary, the plunger 7*e*, the housing 7*a*, the center post 7*c* and so on are made of a magnetic material (e.g., martensitic stainless steel) so that, when magnetized, the plunger 7*e* is attracted to move leftward by the center post 7*c*. In FIGS. 1 to 4, reference numeral 24 indicates mounting bolts for mounting the end block 11; numeral 25 a mounting screw for mounting the control valve 16; numeral 26 packings; numeral 27 a buried plug; numeral 28 mounting holes for mounting the body 1; numeral 29 a terminal board; and numeral 30 a terminal cover.

The operations of the ejector pump thus constructed will be described in the following. The suction port 6 in the lower side of the body 1 is connected to a suction disk B of a vacuum grasping device, for example, by way of a conduit 31, and the lefthand inlet port 21 is connected to a compressed air supply such as a compressor so that it is supplied with compressed air. Then, the air flows into the gap or space 9 via the air chamber 12, the opening 19, the communication passage *7d'* and the communication passage or hole 8. In the shown state, however, the moving member A is urged by a spring 32, which is disposed at the lefthand or upstream end, so that the valve member 10 which is pressed by the leading end portion a to the inlet port or nozzle opening *3a* closes the nozzle opening *3a*. In this state, moreover, the valve member 13 at the upstream portion of the moving member A is opened so that the air flows from the valve seat 14 via the communication passage 15 to the control valve 16.

Next, if the solenoid *7b* is energized in this state, the plunger *7e* is attracted by the center post *7c*, as has been described above, so that the moving member A is moved leftward against the force of the spring 32 to cause the valve member 10 to open the nozzle opening *3a*. As a result, the compressed air is guided through the space or gap 9 and injected from the nozzle opening *3a* into the ejector passage *2a* so that it sucks the air in the suction disk or pad B from the suction chamber 4 into the ejector bore or passage *2a* until the air sucked is discharged to the outside through a silencer 33. As a result, the suction disk B is evacuated so that it can apply a suction to an article C to transport it to a desired place.

When the nozzle opening *3a* is to be opened by the aforementioned valve member 10, the moving member A first moves to the left, as viewed in FIG. 1, i.e., to the upstream of the compressed air flow to carry only the downstream end portion a of the plunger *7e* because the valve member 10 is loosely fitted on the plunger end portion a, as has been described hereinbefore. As a result, the compressed air in the space or gap 9 is allowed to flow through the clearance between the downstream end portion a and the valve member 10 until it is injected into the nozzle opening *3a* from the communication opening *10b* of the downstream end of the valve member 10 to establish a back pressure. This back pressure brings back the valve member 10 apart from the entrance of the nozzle passage opening *3a*. Thus, the valve member 10 can be easily attracted to the upstream direction from the nozzle passage *3a* even if it is strongly forced thereto.

On the other hand, a space or gap 34 to be formed between the center post *7c* and the plunger *7e* has communication with the communication passage *7d'* by way of communication openings 35 which are formed in the communication pipe *7d*. As a result, the air which might otherwise be confined in the space or gap 34 is allowed to flow into the communication passage *7d'* via the communication openings 35, when the moving member A moves upstream, and vice versa, when in the movement to the downstream, so that the moving member A can be brought back and forth without difficulty. At the same time, the forces to be applied to the two end faces of the moving member A by the air pressure are balanced at all times to facilitate the movement of the moving member A. In place of the aforementioned communication openings 35, a suitable clearance may be formed between the center post *7c* and the communication pipe *7d* or between the plunger *7e* and the bobbin *7b'* and the housing of the solenoid *7b* so that the gap or space 34 may communicate with the air chamber 12 or the clearance space or gap 9. Since the moving member A causes the valve member 13 at its upstream portion to close the valve seat 14 when it is moved to upstream, moreover, the supply of the compressed air to the control valve 16 is interrupted.

After the article C has been transported, the solenoid *7b* is deenergized by means of the switch (although not shown). Then, the moving member A is thrust to downstream by the action of the spring 32 to cause the valve member 10 to shut off the nozzle opening *3a* so that the ejector pump is stopped. In this situation meanwhile, the valve member at the upstream end portion of the moving member A opens the valve seat 14 so that the compressed air is supplied to the control valve 16 via the communication hole opening 15. If the opening of the control valve 16 is adjusted to a proper value, the compressed air is forcibly supplied from the control valve 16 via the groove 17 and the communication hole 18 to the suction port 6 so that the suction disk B can be promptly relieved from the vacuum to release the article C. Thus, the operations of carrying the article C can be conducted promptly and accurately.

Figure 5:
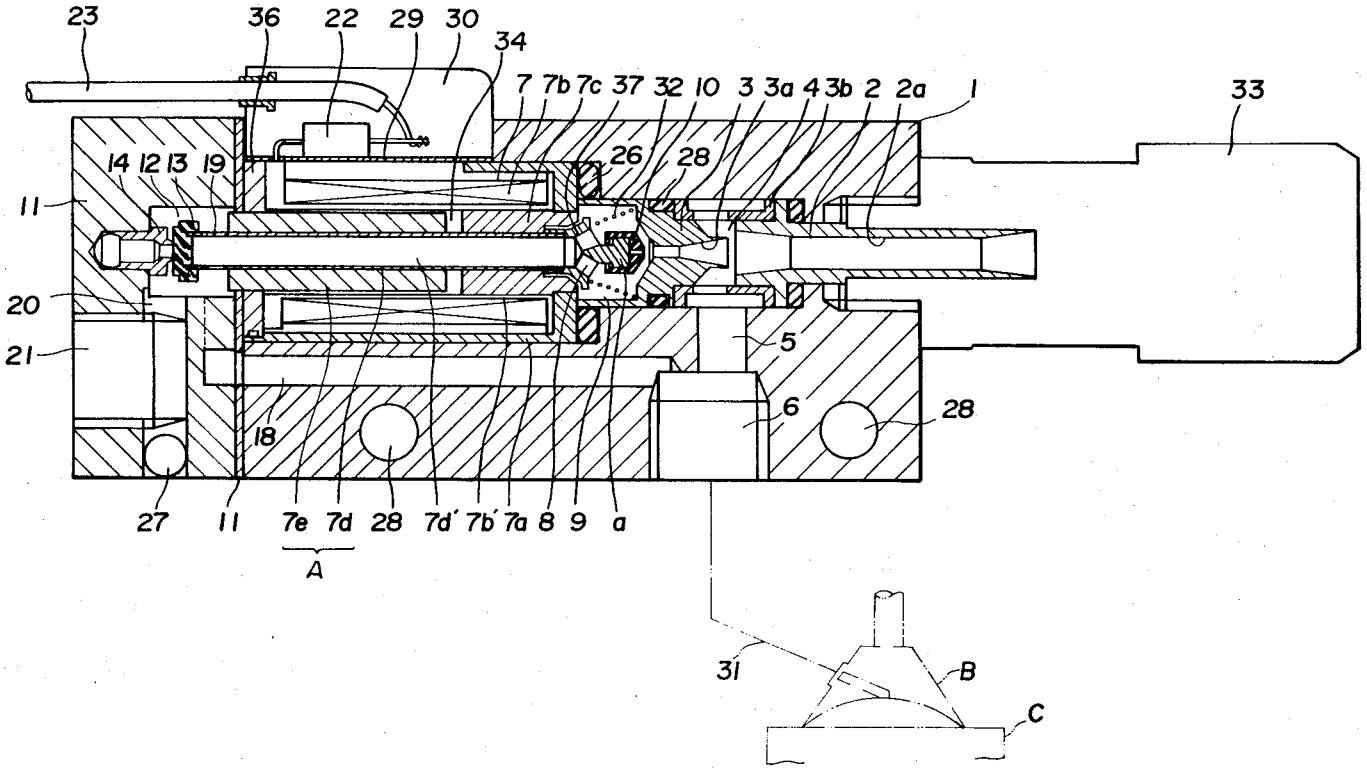
FIG. 5 is a longitudinal sectional front elevation of another embodiment of the present invention.

FIG. 5 shows another embodiment of the ejector pump according to the present invention. In this embodiment, the center post is fixed on the righthand or downstream end portion of the solenoid bobbin *7b'* and in a hole formed in the end portion of the housing *7a*, and a plate member 36 of a magnetic material is fixed in the lefthand or upstream opening in the housing *7a* to form a magnetic path together with the housing *7a*. Moreover, the plunger *7e* is fixed on the lefthand end portion of the communication pipe *7d* to construct the moving member A together. On the leading or downstream end portion of the communication pipe *7a*, there is fixed an end member 37 which has the communication hole 8 and a head a. On this head a, there is carried the valve member 10 which is provided for closing the nozzle hole *3a*. The spring 32 is sandwiched between the end member 37 and the nozzle block 3 such that it normally biases the moving member A to the left or upstream to open the nozzle hole *3a* thereby to actuate the ejector pump. When the solenoid *7b* is energized, the plunger *7e* is attracted by the center post *7c* to the right or downstream against the action of the spring 32 so that the valve member 10 shuts off the nozzle hole *3a* to stop the pump. In this second embodiment, the gap 34 between the center post *7c* and the plunger *7e* is made to communicate with the air chamber 12 by way of the clearance between the outer circumference of the plunger *7e* and the bobbin *7b'*, the plate member 36 and so on. The remaining construction is absolutely identical to that of the first amendment As has been described hereinbefore, according to the present invention, the electromagnetic valve 7 is mounted in the ejector pump body 1 so that its moving member A may directly open the nozzle opening *3a* with its leading or downstream end portion a. Therefore, the ejector pump of the present invention is superior to that of the prior art in that it can have its structure remarkably simplified and small-sized. By using member A having the communication passage *7d'*, moreover, the pressures to be applied to the two end portions of the moving member A are balanced so that the moving member A can be moved back and forth very smoothly by the relatively weak spring 32 or by a relatively weak magnetic force. Moreover, the nozzle opening 3*a* is opened by the electrical power supply, the electromagnetic valve is effectively cooled down by the air flow through the communication opening *7d'* so that the solenoid can be prevented from becoming overheated even if the ejector pump is run for a long time. According to the present invention, therefore, it is possible to provide an ejector pump which has a number of excellent advantages.

What is claimed is:

1. An air ejector pump comprising, a pump body having an elongate bore and suction port open to a side thereof, a nozzle in said bore having a nozzle opening, an air ejector in said bore spaced from the nozzle defining therebetween a suction chamber, said air ejector having an air passage in communication with said suction chamber and the exterior of the pump body aligned with said nozzle opening, means defining a communication passage between the suction chamber and the suction port, an electromagnetic valve in said elongate bore having a plunger axially displaceable in said bore and a solenoid surrounding said plunger, the electromagnetic valve plunger having an axial passage for flow of air therethrough and a valve member on a leading end portion of the plunger for closing and opening said nozzle opening when the electromagnetic valve is energized in dependence upon whether the nozzle opening is opened or closed by the valve member on the leading end portion of the plunger when the electromagnetic valve is in a deenergized state, means biasing the plunger to close the nozzle opening, said plunger having said passage in communication with said suction chamber, the pump body having an air inlet port for supplying of air under pressure into said axial passage of the electromagnetic valve, means defining an air chamber in communication with the inlet port and the axial passage, an outlet port in said air chamber opened and closed by the electromagnetic valve to allow entry of compressed air into said suction port when open and to isolate the air chamber from the suction port when closed, a valve element mounted on the electromagnetic valve for opening and closing the air outlet port, said solenoid energizing the electromagnetic valve to position it to establish communication through said axial passage between the inlet port for air under pressure and the air ejector opening to thereby apply a suction at the suction port and to close the outlet port.

2. An air ejector pump according to claim 1, in which said biasing means biasing said plunger biases the plunger in a deenergized state of the electromagnetic valve to a forward position closing the nozzle opening to thereby interrupt the application of a vacuum to said suction port.

3. An air ejector pump according to claim 2, in which said biasing means is a biasing spring, said solenoid energizing the electromagnetic valve to move the plunger against action of the biasing spring and establish communication between the inlet port and the nozzle passage for developing a suction at the suction port.

* * * * *